US005176208A

United States Patent [19]

Lalande et al.

[11] Patent Number: 5,176,208

[45] Date of Patent: Jan. 5, 1993

[54] REVERSE CIRCULATION TOOL HANDLING CUTTINGS AND DEBRIS

[75] Inventors: Phillip T. Lalande, Lafayette; Milton H. Madeley, Jr., New Iberia, both of La.

[73] Assignee: Ponder Fishing Tools, Inc., Alice, Tex.

[21] Appl. No.: 673,230

[22] Filed: Mar. 20, 1991

[51] Int. Cl.[5] ..... E21B 31/08

[52] U.S. Cl. ..... 166/99; 166/162; 175/312

[58] Field of Search ..... 166/99, 141, 162; 175/215, 308, 312

[56] References Cited

U.S. PATENT DOCUMENTS

| | | | |
|---|---|---|---|
| 2,894,725 | 7/1959 | Baker | 175/312 |
| 3,023,810 | 3/1962 | Anderson | 175/312 |
| 3,120,872 | 2/1964 | Anderson | 175/312 |
| 3,198,256 | 8/1965 | Kirby, III | 166/99 |

FOREIGN PATENT DOCUMENTS

| | | | |
|---|---|---|---|
| 0565985 | 7/1977 | U.S.S.R. | 166/99 |

OTHER PUBLICATIONS

Drilling (Exposition In Print), "New Drill Removes Plugs And Packers Without Rotary Rig", Baker Sand Line Drill, May 15, 1964, p. 89.

*Primary Examiner*—Terry Lee Melius

*Attorney, Agent, or Firm*—Gunn, Lee & Miller

[57] ABSTRACT

A device for providing fluid cross over in a milling operation is set forth. It is particularly used by connection to a pipe string which supports the milling device for cutting junk from a well. It features an elongate hollow tool body having a central portion which defines a trash receiving chamber. There is a pipe inserted into this chamber from below for introducing return fluid after cutting which is laden with metal shavings, chips, and trash. In this chamber, fluid flows upwardly through the pipe, and trash collects in the chamber by surrounding the pipe falling to the bottom of the chamber by weight. The chamber is limited at the top end by transverse wall which has a number of perforations having an aggregate cross sectional area to prevent fluid flow restriction. Fluid flow cross over is accomplished whereby new fluid is introduced through the pipe string, flows to the exterior below a rubber pack off, flushes the cuttings downwardly and away from the milling device, and returns the fluid up through the tool where trash in the fluid is captured.

17 Claims, 1 Drawing Sheet

REVERSE CIRCULATION TOOL HANDLING CUTTINGS AND DEBRIS

BACKGROUND OF THE DISCLOSURE

Assume that in a completed well it is necessary to use some kind of milling tool for removal of a packer, bridge plug, or the like from the well. This is done by grinding by means of a cutting tool which is affixed on a pipe string. In grinding, shaving are created, and they will ordinarily create a nest around the cutting tool, plugging the well and thereby preventing continued fluid flow. They will clogged the annular space in the well on the exterior of the pipe string supporting the cutter.

The present apparatus is directed to a reverse circulation sub attached to pipe string and which is equipped with a crossover so that circulation can be diverted to the exterior to wash cuttings downwardly and is also provided with an upward flow path through the tool for the circulation which will carry cuttings upwardly into the tool. In the tool itself, the circulation is directed upwardly and into an internally located basket. This basket is defined by a standpipe in the center and a long annular cavity for receiving, storing, and holding cuttings, and is also able to deliver fluid out of this chamber flowing upwardly through a shield which keeps the cuttings in the chamber. This permits the circulating fluid to escape the chamber and complete the circulation flow path.

The present apparatus particularly will hold and capture cuttings, whether long or short, and they are captured at a location where they do not interfere with cutting. The cutter normally is required to operate over a fairly long time interval depending on the size of the object being milled. As it is cut, the shavings are broken and delivered into an internal storage chamber. This storage chamber has sufficient length that circulation into the storage chamber collects most of the cuttings in that chamber. Thus, the tool is run into the well with the chamber empty and is operated for as long as needed, and is also operated to gather and collect all these cuttings in the internal chamber.

The present apparatus is summarized as a reverse circulation crossover sub which receives well fluid through a pipe string where the fluid flows axially through the top part of the tool and is then circulated to the exterior by jets directed to the exterior of the sub. The fluid then flows on the exterior downwardly along the tool to the bottom and around the cutter which is attached at the bottom of the tool. There is a fluid pathway up through the center of the tool, and this pathway is directed upwardly through a bottom sub and then to a standpipe inside a chamber. This chamber is defined by the surrounding sidewall of the tool structure. This chamber collects trash including short chips and long spiral cuttings also. The standpipe is perforated at several midpoints to create a circular flow path carrying the cuttings to the bottom of this chamber. Fluid fills the chamber and flows out the top end through a deflector shield at the top of the chamber. Fluid then flows upwardly from the deflector shield along a pathway on the interior of the tool and then is ultimately routed to the exterior through return ports. This fluid is routed at the very top end of the tool to flow in the annular space. Below these ports, there is a resilient casing pack off which assists in isolating the cutter so that all fluid at the cutter is flowing downwardly on the exterior.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
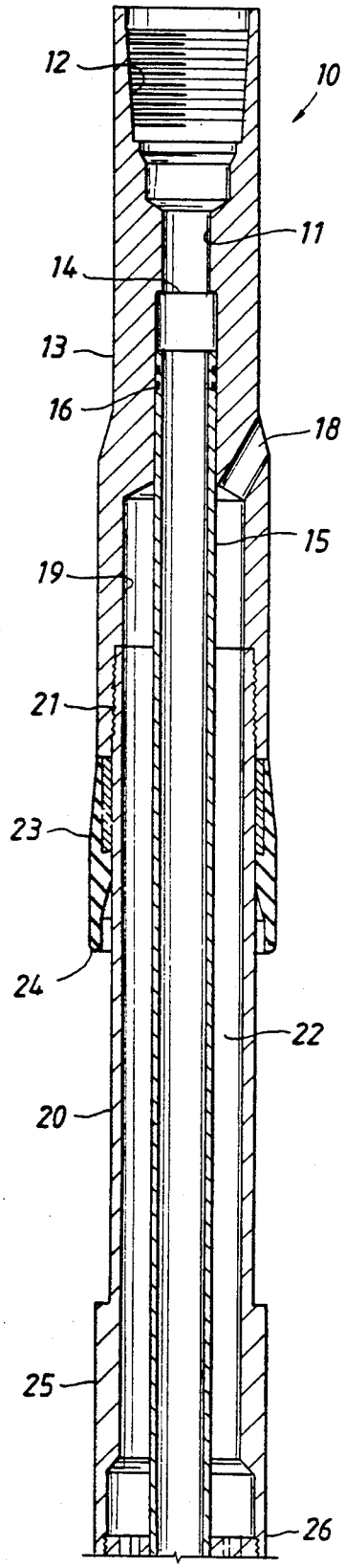
FIGS. 1, 2, and 3 jointly and serially show the tool of the present disclosure proceeding from the top to the bottom of the tool where the tool is represented in cross section which shows how fluid flow is directed down through the tool, crossover is accomplished and lubrication for a cutter attached to the lower end of the tool is accomplished and cuttings are removed and captured internally of the tool.

Attention is first directed to FIG. 1 of the drawings where the tool of the present disclosure is generally identified by the reference numeral 10. The tool 10 is affixed to a pipe string. It has a conventional pin and box connection with the pipe string at the upper end, and the lower end is also provided with a conventional connection for threaded connection to a cutter such as a milling tool, junk cutter or the like. It is intended to be run typically in a cased well to cut and thereby remove trash in the well such as an old packer which is to be removed. The ordinary context of the device therefore places it on the pipe string as mentioned for rotation of a cutter (not shown), and this normally occurs in a cased well where there is an annular space for fluid flow back to the surface.

The pipe string is used to deliver fluid flow down through the tool 10. The fluid flow is introduced through a passage 11 which is below the threaded box connection 12 which connects the tool in the pipe string. The flow is downwardly through the passage 11 which is formed axially in the top sub 13. The sub includes an internal transverse shoulder 14 which limits the penetration of a flow pipe 15 on the interior. The pipe 15 is sealed by suitable seals 16 to prevent leakage along the exterior. The pipe 15 is a downward flow path for clean fluid from the pipe string. The sub is constructed with a return port 18, therebeing two or three in the preferred form, and more will be noted regarding them hereinafter.

As will be observed, the sub 13 is axially hollow and has an enlarged opening at 19 which makes a threaded connection with a polished mandrel 20, the threaded connection being at 21. This defines an internal annular flow space 22 which extends the full length of FIG. 1 and terminates at the upper end at the return ports 18 and cooperates in a manner which will be described. Just below the threaded connection 21, there is an external rubber which serves as a casing pack off 23. It has a lip 24 at the lower end which faces downwardly and which is sized to contact the surrounding casing against which it forms a seal which prevents upward flow. The lip 24 provides such a seal. Reenforcing rings are provided in the pack off 23 to hold it stiff and in place against the casing. As will be understood, it telescopes to the upward or raised position as shown in FIG. 1 of the drawings.

Figure 2:
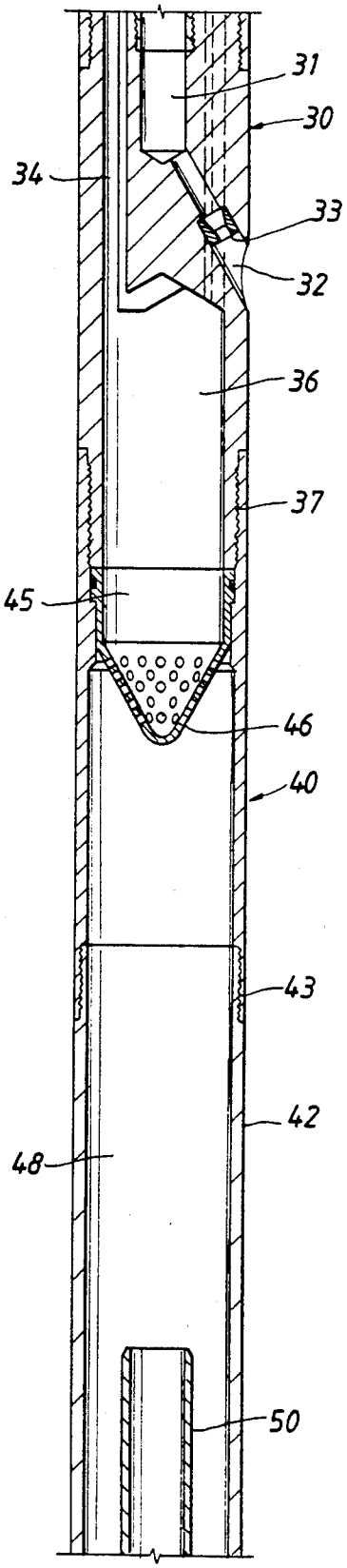
Figure 3:
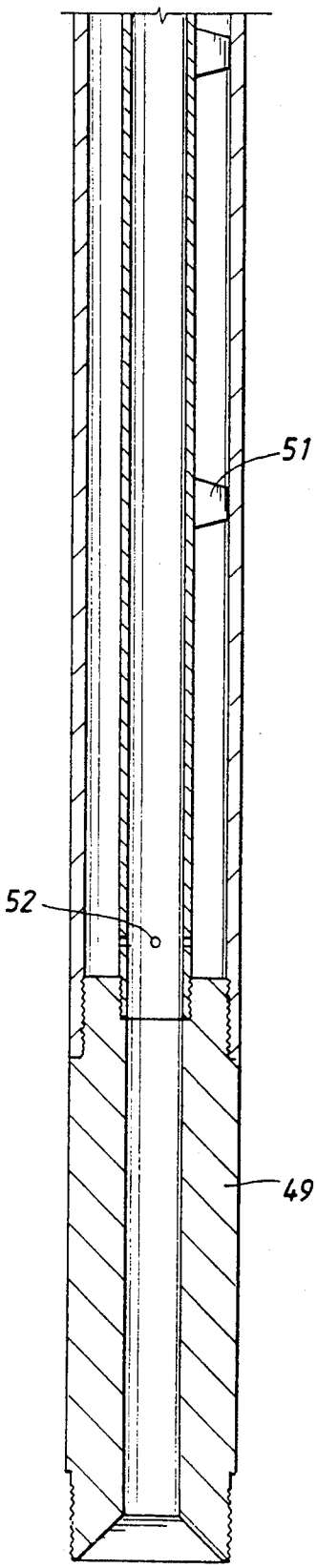

The polished mandrel 20 extends downwardly to a pack off sub 25 and that in turn terminates at a threaded skirt 26 which is provided for connection for assembly of the tool. The skirt 26 threads to a reverse circulating sub 30 at the top portion of FIG. 2. This sub threads so that it is serially assembled in the tool 10 and is held in position. Moreover, it includes a central body which receives and supports the stand pipe 15 which threads to it. That in turn opens into the chamber 31 in the sub 30. There is downward flow in the chamber 31, and it is directed to the exterior through a circulating port 32. The device is preferable constructed with two, and ideally, three similar circulating ports arranged at 120° angles with respect to each other. More importantly, each circulating port includes a restriction at 33. The restrictions 33 create a jet flow in the annular space. The restriction at the jet 33 causes jetting action of the fluid which is discharged.

The sub 30 includes selected vertical passages 34 which extend upwardly, but they do not interconnect with the circulating ports 32. Assuming that there are three circulating ports, there are preferably also three upward passages 34 which are alternately positioned among the parts. The cross sectional area of the ports 32 as well as the upwardly directed passages 34 are preferably sized so that there is no constriction to fluid flow.

Interrupting the equipment description for the moment, directions of fluid flow should be noted. Fluid flows downwardly from the pipe string and into the standpipe 15 and then into the chamber 31. At this point, the fluid then flows radially outwardly with jetting action through the circulating ports 32 and then is located on the exterior of the tool and below the casing pack off previously mentioned. Conversely, there is upward flow through the passages 34 (from a source to be described) and that flow continues upwardly on the exterior of the standpipe 15 in the annular flow space 22. This fluid flows upwardly to the return ports 18. Preferably, the are three such return ports, and the return fluid is thus directed from the interior of the tool to the exterior. The ports 18 point upwardly and away from the casing pack off 23 below these ports. This isolates the return flow above the pack off and directs it towards the surface.

The sub 30 includes a return fluid chamber 36 which is incorporated for supply of the vertical passages 34. Moreover, it is located at a threaded connection 37 which joins a deflector sub 40 in the tool. The sub 40 connects as mentioned at 37 and extends downwardly to a basket sub 42, and these are threaded together at 43. The deflector sub 40 is constructed with a removal perforated deflector shield 45. The deflector shield 45 is constructed with a number of performations in it and tapers to a point 46. This enables the deflector shield to be provided with a very substantial cross sectional flow area so that it does not constrict fluid flow through the perforations. Further, the deflector shield 46 is provided with individual small openings, but the net cross sectional area of the openings is quite large. The individual openings are small to enable upward fluid flow through the deflector shield while capturing the shavings and chips.

The chamber 48 can be designed to any length. It is located within the sub 42 as mentioned which defines the outer cylindrical wall below the threaded connection 43 and below the conic shape screen at 45. It extends downwardly to a bottom sub 49 and threads to that sub. That sub supports a central upstanding and closed trash pipe 50. The pipe is preferably centered to define the chamber 48 on the exterior with is concentric thereabout, and this arrangement utilizes spacers, one or more, at 51. In addition to the spacers, there are ports 52. These enable fluid in the trash chamber 48 to flow back into the trash pipe 50 where it is carried upwardly and away from accumulated trash. The lower end of the sub is threaded as mentioned so that it can be threaded to a cutting tool.

DESCRIPTION OF THE FLUID FLOW PATH

Assume for purposes of description that the tool 10 is connected in a pipe string and supports a cutting device at the lower end and is lowered into a cased well to mill a six foot long packer from the cased well. The pipe string is lowered into the well until the packer is engaged and the pipe string is then rotated to initiate cutting. Fluid flow is initiated downwardly through the pipe string and flows into the top end of the tool at the passage 11 and flows into the pipe 15. Downward flow continues through that region to the chamber 31 at the top of FIG. 2 of the drawings and is directed outwardly. It flows through the circulating jets 32 and is directed downwardly but is in the annular space on the exterior of the tool 10. This flow goes downwardly in that area or region and flows to the cutter which is milling or grinding out the old packer. It flows downwardly and around the cutter and is received back into the tool 10 to flow upwardly completing a circulation flow path back through the trash pipe 50. This flow extends upwardly through the trash chamber 48. As will be understood, this flow will carry cuttings which are forced by the fluid flow into the chamber 48 and which fall into the annular gap around the trash pipe 50. Fluid that falls into this annular space will collect at the bottom but is returned to the interior of the trash pipe through the ports 52. The fluid flows into the chamber 48 from the bottom and out the top. It is screened as it flows from the chamber. The screened fluid then flows into the chamber 36 and upwardly through the passages 34. Those passages open into the annular space 22 (shown in FIG. 1) and flow to the top end to the relief ports 18 which forces the fluid to the exterior of the tool. Fluid return to the surface is through the annular space outside the pipe string. When the junk has been drilled through, the drilling process will end as the cutting device completes destruction of the junk, and at that point, the drilling process is completed. The tool can ultimately be retrieved to the surface along with the pipe string. When retrieved, it can be disassembled by breaking the thread at 43 or the bottom sub 49. In either case, this exposes the chamber 48 so that the trash collected in the trash chamber 48 can then be removed. One of the virtues of the present device is that trash is held in this region so that it does not stay in the area of the cutter. When removed away from the cutter, improve cutting occurs because the trash including the long spiral shaped chips may defeat smooth operation of the equipment.

While the foregoing is directed to the preferred embodiment, the scope thereof is determined by the claims which follow.

What is claimed is:

1. A reverse circulation tool connected to pipe string for operation of a milling device, comprising:

(a) an elongate hollow tool body having upper and lower ends and having an axially aligned central passage in the upper portion thereof which a pipe string fluid circulation is directed;

(b) externally directed port means located below an externally located resilient pack off wherein said port means is connected to said passage to direct fluid flow from the passage into an annular flow space around said tool body to flow downwardly to lubricate a milling device connected below said tool body;

(c) an internally located, upwardly directed fluid flow, trash receiving passage extending upwardly from the lower end of said tool body;

(d) an elongate trash receiving chamber in said tool body connected with said trash receiving passage to enable fluid flow and trash from the milling device to enter said chamber and to also collect such trash in said chamber; and (e) a fluid removing passage from said chamber connected for fluid removal from said trash receiving chamber wherein said passage extends through said tool body to an outlet port to exhaust fluid from said tool body into an annular flow space around said tool body above said port means to return fluid along the pipe string.

2. The apparatus of claim 1 wherein said trash receiving passage terminates in an upstanding pipe concentric in said trash receiving chamber.

3. The apparatus of claim 2 wherein said trash receiving chamber extends downwardly and surrounds said upstanding pipe.

4. The apparatus of claim 3 wherein said trash receiving chamber is defined by an external wall of said tool body having the form of an elongate cylindrical portion fitting around and concentric about said upstanding pipe, and wherein said pipe is spaced therefrom by one or more spacers to define said trash receiving chamber, and wherein said pipe includes one or more perforations through said pipe below the top end thereof wherein the perforations provide a fluid flow path from said trash receiving chamber into said pipe.

5. The apparatus of claim 4 wherein said trash receiving chamber is isolated within said tool body by a transverse member fully closing said chamber and having a set of perforations therein of sufficient total cross sectional area so that no constriction to fluid flow is formed thereby and wherein said perforations are sized so that trash within said trash receiving chamber is prevented from passing through said perforations.

6. The apparatus of claim 5 wherein said transverse member is perforate transverse member snuggly fitting within said cylinder.

7. The apparatus of claim 6 wherein said transverse member has a circular periphery supporting a folded surface with said perforations.

8. The apparatus of claim 1 wherein said externally directed port means opens to the exterior of said tool body near said resilient pack off on the exterior of said tool body which pack off is constructed and arranged so that an outer lip thereof forms sealing contact against a surrounding casing during use, and further wherein said fluid removing passage exhausts fluid through said outlet port above said pack off to accomplish a fluid cross over between the pipe string to the annular space on the exterior of said tool body so that fluid is introduced through the pipe string and is removed through the annual space.

9. The apparatus of claim 8 wherein said tool body includes an elongate cylinder having upper and lower ends wherein said cylinder defines said trash receiving chamber, and wherein said cylinder threads to a sub at the lower end of said tool body and threads to a sub thereabove in said tool body, and said lower sub is adapted to be connected to a milling device.

10. A reverse circulation tool connected to a pipe string for operation of a milling device, comprising:

(a) an elongate hollow tool body having upper and lower ends and having an axially aligned central passage in the upper portion thereof adapted to be connected to a pipe string to receive a fluid circulation;

(b) a fluid flow isolation means on the exterior around said tool body;

(c) externally directed port means below said isolation means, said port means being connected to said passage to direct fluid flow from said passage into an annular flow space around said tool body to flow downwardly to lubricate a milling device connected below said tool body;

(d) an internally located, upwardly directed, fluid flow, trash receiving passage extending upwardly from the lower end of said tool body;

(e) an elongate trash receiving chamber in said tool body connected with said trash receiving passage to enable fluid flow and trash from the milling device to enter said chamber and to also collect such trash in said chamber; and (f) a fluid removing passage from said chamber connected for fluid removal from said trash receiving chamber wherein said passage extends through said tool body to an outlet port to exhaust fluid from said tool body into an annular flow space around said tool body above said fluid flow isolation means to return fluid externally of the pipe string.

11. The apparatus of claim 10 wherein said fluid flow isolation means is below said outlet ports of said fluid removing passage.

12. The apparatus of claim 11 wherein said trash receiving passage terminates in an upstanding pipe concentric in said trash receiving chamber.

13. The apparatus of claim 12 wherein said trash receiving chamber extends downwardly and surrounds said upstanding pipe.

14. The apparatus of claim 13 wherein said trash receiving chamber is defined by an external wall of said tool body having the form of an elongate cylindrical portion fitting around and concentric about said upstanding pipe, and wherein said pipe is spaced therefrom by one or more spacers to define said trash receiving chamber, and wherein said pipe includes one or more perforations through said pipe below the top end thereof wherein the perforations provide a fluid flow path from said trash receiving chamber into said pipe.

15. The apparatus of claim 14 wherein said trash receiving chamber is isolated within said tool body by a transverse member fully closing said chamber and having a set of peforations therein of sufficient total cross sectional area so that no constriction to fluid flow is formed thereby and wherein said perforations are sized so that trash within said trash receiving chamber is prevented from passing through said perforations.

16. The apparatus of claim 14 wherein said transverse member is a perforate transverse member snugly fitting within said cylinder.

17. The apparatus of claim 16 wherein said transverse member has a circular periphery supporting a folded surface with said perforations.

* * * * *